US010124956B2

(12) United States Patent
McDowell

(10) Patent No.: US 10,124,956 B2
(45) **Date of Patent: *Nov. 13, 2018**

(54) LIQUID CONTAINMENT SYSTEM THAT ACCOMMODATES VEHICLE INGRESS AND EGRESS

(71) Applicant: NEWPARK MATS & INTEGRATED SERVICES LLC, The Woodlands, TX (US)

(72) Inventor: James Kerwin McDowell, Lafayette, LA (US)

(73) Assignee: Newpark Mats & Integrated Services LLP, The Woodlands, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/685,407

(22) Filed: Aug. 24, 2017

(65) Prior Publication Data

US 2017/0349372 A1 Dec. 7, 2017

Related U.S. Application Data

(63) Continuation of application No. 14/720,799, filed on May 24, 2015, now Pat. No. 9,745,124, which is a continuation of application No. 13/790,916, filed on Mar. 8, 2013, now Pat. No. 9,039,325.

(51) Int. Cl.

| | |
|---|---|
| ***B65D 90/24*** | (2006.01) |
| ***E02D 31/00*** | (2006.01) |
| ***E01C 9/08*** | (2006.01) |
| ***E01H 1/00*** | (2006.01) |
| ***B65D 90/26*** | (2006.01) |

(Continued)

(52) U.S. Cl.

CPC ..... *B65D 90/24* (2013.01); *B65D 90/26* (2013.01); *E01C 9/086* (2013.01); *E01H 1/001* (2013.01); *E02B 8/04* (2013.01); *E02D 31/002* (2013.01); *E04H 17/16* (2013.01); *H05K 999/99* (2013.01)

(58) Field of Classification Search

USPC ..... 405/52, 107, 114, 129.45, 129.6, 129.7, 405/129.75, 129.8, 129.85; 220/4.33, 220/4.28, 571, 573, 692; 137/312; 404/7, 8, 35

See application file for complete search history.

(56) References Cited

U.S. PATENT DOCUMENTS

| | | | | |
|---|---|---|---|---|
| 4,765,775 A * | 8/1988 | Kroger | ..... | B65D 90/24 405/129.8 |
| 5,653,551 A | 8/1997 | Seaux | | |
| 5,689,920 A | 11/1997 | Hallsten | | |

(Continued)

FOREIGN PATENT DOCUMENTS

| | | |
|---|---|---|
| CN | 1957144 A | 5/2007 |
| CN | 101259905 A | 9/2008 |

(Continued)

*Primary Examiner* — Sean D Andrish

(74) *Attorney, Agent, or Firm* — E. Randall Smith; E. Randall Smith, P.C.

(57) ABSTRACT

A system for assisting in preventing the leakage of liquid from an outdoor work-site and allowing vehicle ingress onto and egress off of the work-site includes a plurality of berm members configured to be positioned at least partially around the perimeter of a support surface and extend upwardly relative thereto. At least one berm member comprises a drive-over barrier.

20 Claims, 10 Drawing Sheets

(51) Int. Cl.
*E02B 8/04* (2006.01)
*E04H 17/16* (2006.01)

(56) References Cited

U.S. PATENT DOCUMENTS

| | | | | |
|---|---|---|---|---|
| 6,511,257 | B1 * | 1/2003 | Seaux | E01C 9/086 404/34 |
| 6,648,008 | B1 * | 11/2003 | Price | B08B 17/00 134/104.2 |
| 6,695,527 | B2 | 2/2004 | Seaux et al. | |
| 6,881,010 | B2 | 4/2005 | Cash | |
| 7,413,374 | B2 | 8/2008 | Rogers et al. | |
| 8,246,272 | B1 | 8/2012 | Heitz | |
| 8,414,217 | B2 | 4/2013 | Rosan | |
| 9,039,325 | B2 * | 5/2015 | McDowell | E02D 31/002 405/114 |
| 9,745,124 | B2 * | 8/2017 | McDowell | B65D 90/24 |
| 2012/0193369 | A1 | 8/2012 | Beak et al. | |
| 2012/0321382 | A1 | 12/2012 | Rosier | |

FOREIGN PATENT DOCUMENTS

| | | | |
|---|---|---|---|
| CN | 201502017 | U | 6/2010 |
| GB | 2433539 | A | 6/2007 |
| WO | 01/92638 | A1 | 12/2001 |

* cited by examiner

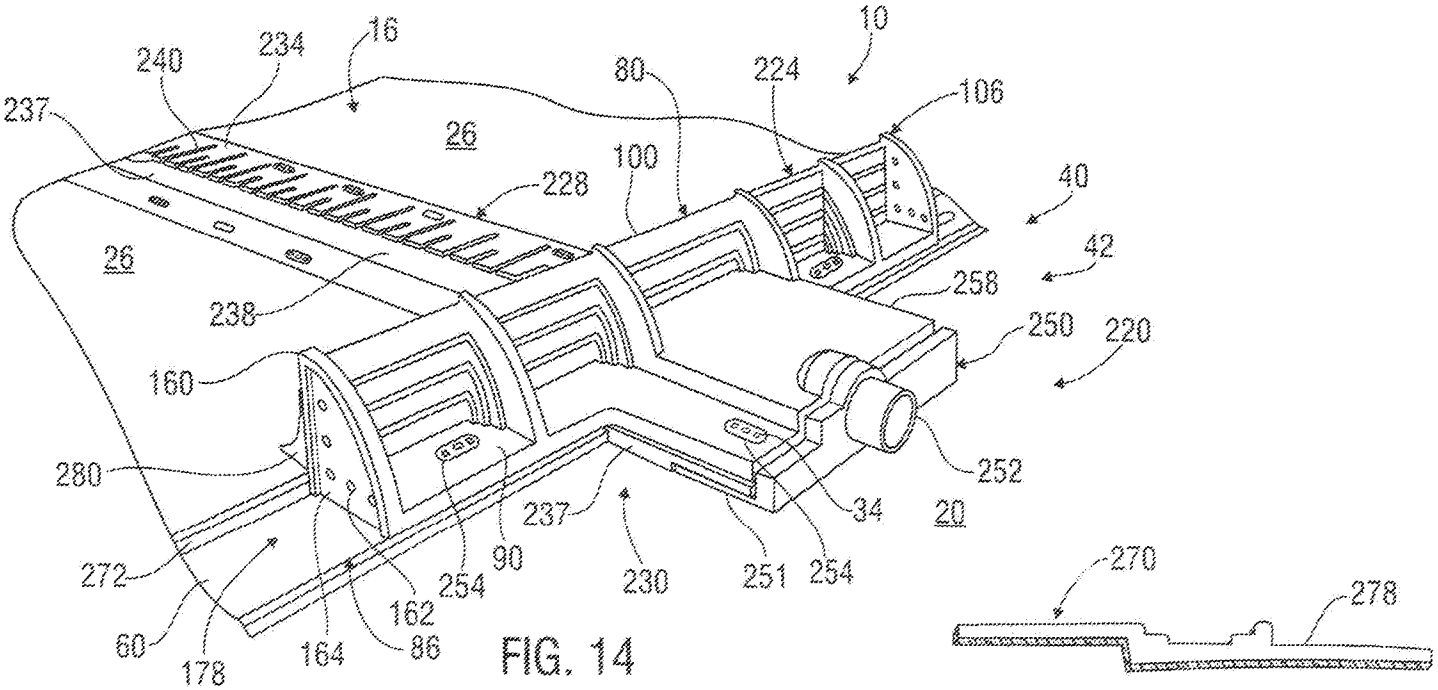
FIG. 14
FIG. 15
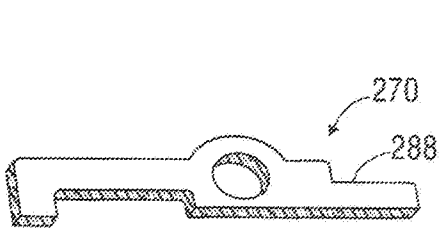
FIG. 17
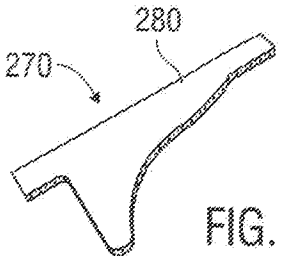
FIG. 16

LIQUID CONTAINMENT SYSTEM THAT ACCOMMODATES VEHICLE INGRESS AND EGRESS

CROSS REFERENCE TO RELATED APPLICATIONS

This application is a continuation application of and claims priority to U.S. patent application Ser. No. 14/720,799 filed on May 24, 2015 and entitled "Liquid Containment System", which is a continuation of and claims priority to U.S. patent application Ser. No. 13/790,916 filed on Mar. 8, 2013 and entitled "Liquid Containment System for use with Load-Supporting Surfaces", which issued as U.S. Pat. No. 9,039,325 on May 26, 2015, both of which are hereby incorporated by reference herein in their entireties.

FIELD OF THE DISCLOSURE

The present disclosure relates generally to preventing the leakage of liquid from a load-supporting surface and, more particularly, to a liquid containment system.

BACKGROUND

Temporary or semi-permanent support surfaces have been used for roadways, remote jobsites, industrial staging areas and the like in an ever-increasing myriad of industries, such as construction, military, oilfield, transportation, disaster response, utilities and entertainment. These support surfaces are often made up of heavy duty, durable, all-weather thermoplastic mats, which are reusable and interlock together to form the support surface. Traditionally, a plastic liner is placed below and around the mat assembly in an effort to capture liquids that are spilled or otherwise introduced onto the support surface before such liquids encounter the subgrade terrain.

The use of liners with temporary or semi-permanent support surfaces may have one or more disadvantages. In many instances, once the need for the temporary support surface has lapsed, the interlocking mats are disassembled for later use. However, since the liners, unlike the mats, are not normally reusable, they must often be discarded. This can be problematic because landfill operators have expressed disinterest in accepting used liners on the basis that they are bulky and require excessive landfill space, or for other reasons. Thus, it can be difficult to find suitable, cost-effective ways to dispose of the liners. For another example, the plastic liners are sometimes ineffective at preventing fluid leakage from the support surface or allowing effective clean-up, which can cause other problems and require significant time and effort. Thus, there is a need for improved apparatus, systems and methods for containing liquids spilled or otherwise introduced onto a load-supporting surface.

It should be understood that the above-described features, capabilities and disadvantages are provided for illustrative purposes only and is not intended to limit the scope or subject matter of the appended claims or those of any related patent application or patent. Thus, none of the appended claims or claims of any related application or patent should be limited by the above discussion or construed to address, include or exclude each or any of the above-cited features, capabilities or disadvantages merely because of the mention thereof herein.

Accordingly, there exists a need for improved systems, articles and methods useful in connection with containing liquids introduced onto a load-supporting surface having one or more of the attributes or capabilities described or shown in, or as may be apparent from, the other portions of this patent.

BRIEF SUMMARY OF THE DISCLOSURE

In various embodiments, the present disclosure involves a system for assisting in preventing the leakage of liquid from an outdoor work-site and allowing vehicle ingress onto and egress off of the work-site. The system includes a load-supporting surface having an upper surface and including at least two adjacent mats forming a perimeter thereof. Each mat includes at least one locking pin hole formed therein and configured to receive a releasable locking pin therethrough for connection to at least one other component. The load-supporting surface is configured to support the weight of people, vehicles and equipment thereupon. A plurality of berm members is configured to be positioned at least partially around the perimeter of the load-supporting surface and extend upwardly relative to the mats. The berm members are configured to prevent liquid disposed upon the upper surface of the load-supporting surface from leaking off of the load-supporting surface around the perimeter of the load-supporting surface. Each berm member includes at least one locking pin hole configured to receive a releasable locking pin therethrough for connection to at least one other component, first and second ends and a base extending between the first and second ends. Each base has front and rear edges. At least one berm member comprises a drive-over barrier that sealingly engages the load-supporting surface.

The present disclosure includes embodiments of a system for assisting in preventing the leakage of liquid from an outdoor work-site and allowing vehicle ingress onto and egress off of the work-site. The system includes a load-supporting surface having an upper surface and including at least two adjacent, reusable mats forming a perimeter thereof. The load-supporting surface is configured to support the weight of people, vehicles and equipment thereupon. The perimeter of the load-supporting surface has at least first and second adjacent sides and at least a first corner formed by the intersection of the first and second adjacent sides. A plurality of berm members is configured to be positioned at least partially around the perimeter of the load-supporting surface and extend upwardly relative to the mats. The berm members are configured to prevent liquid disposed upon the upper surface of the load-supporting surface from leaking off of the load-supporting surface. Each berm member includes front and rear edges. At least one berm member is formed in an angular shape and configured to be positioned along the first corner of the perimeter. At least one berm member comprises a drive-over barrier that sealingly engages the load-supporting surface.

There are embodiments of a system for assisting in preventing the leakage of liquid from a support surface that includes a plurality of mats. Each mat has an upper surface and is configured to support the weight of people, vehicles and equipment thereupon. The support surface has a perimeter extending therearound. A plurality of berm members is configured to be positioned at least partially around the perimeter of the support surface and extend upwardly relative thereto. The berm members are configured to prevent liquid disposed upon the upper surface of the mats from leaking off of the mats around the perimeter of the support surface. Each berm member has front and rear edges. At least part of the front edge of each berm member is positionable atop at least part of at least one of the mats during use of the system. At least one berm member comprises a drive-over barrier that sealingly engages the support surface.

In many embodiments the present disclosure involves systems for preventing the leakage of liquid from an outdoor work-site onto the ground around a perimeter of the work-site. The systems include a load-supporting surface having an upper surface and including at least two adjacent, reusable mats forming a perimeter thereof. The perimeter of the load-supporting surface includes at least four sides. The load-supporting surface is configured to support the weight of people, vehicles and equipment thereupon. Each mat is constructed of impermeable plastic. A plurality of berm members configured to be positioned at least partially around the perimeter of the load-supporting surface extend upwardly relative to the mats and prevent liquid disposed upon the upper surface of the load-supporting surface from leaking off of the load-supporting surface around the perimeter thereof. At least one liquid drain assembly is releasably engageable with the load-supporting surface and configured to collect liquid disposed upon and provide controlled drainage of liquid off of the load-supporting surface.

Some embodiments involve systems for preventing the leakage of liquid from an outdoor work-site onto the ground around a perimeter of the work-site. The systems include a load-supporting surface having an upper surface and including at least two adjacent, reusable mats forming a perimeter thereof. The perimeter of the load-supporting surface includes at least four sides, at least first and second the perimeter sides each having an upper lip extending horizontally outwardly therefrom and configured to be spaced above the ground, and at least third and fourth the perimeter sides each having a lower lip extending horizontally outwardly therefrom and configured to rest on the ground. The load-supporting surface is arranged and adapted to support the weight of people, vehicles and equipment thereupon. A plurality of spacers are separate and distinct from the mats. At least some of the spacers have a first section configured to be positioned below the upper lip of at least one among the first and second perimeter sides of the load-supporting surface and a second section extending horizontally outwardly from the first section and configured to extend beyond the corresponding upper lip. A plurality of berm members is configured to be positioned around the perimeter of the load-supporting surface and extend upwardly relative to the mats. At least some of the berm members will rest at least partially atop the respective second sections of at least some of the spacers when positioned around the perimeter of the load-supporting surface.

Various embodiments of the present disclosure involve systems for assisting in preventing the leakage of liquid from an outdoor work-site. The systems include a load-supporting surface having an upper surface and including at least two adjacent, reusable mats forming a perimeter thereof. The load-supporting surface is arranged and adapted to support the weight of people, vehicles and equipment thereupon. The perimeter of the load-supporting surface has at least first and second adjacent sides and at least a first corner formed by the intersection of the first and second adjacent sides. Each mat is constructed of impermeable plastic and includes a plurality of locking pin holes extending therethrough.

A plurality of berm members constructed of impermeable plastic is configured to be positioned at least partially around the perimeter of the load-supporting surface and extend upwardly relative to the mats. The berm members are configured to prevent liquid disposed upon the upper surface of the load-supporting surface from leaking off the load-supporting surface around the perimeter thereof. At least one berm member is arranged and adapted to be driven over by and withstand the weight of vehicles moving onto and off of the mats. Each berm member includes at least one locking pin hole extending therethrough. Each among a plurality of releasable locking pins is configured to extend through and releasably couple an adjacent pair of the locking pin holes in an adjacent pair of the mats or a mat and adjacent berm member.

The present disclosure also includes embodiments of a liquid containment system for use at an outdoor work-site. The systems include a load-supporting surface having an upper surface and including at least two adjacent, reusable mats forming a perimeter thereof. The load-supporting surface is arranged and adapted to support the weight of people, vehicles and equipment thereupon. The perimeter of the load-supporting surface includes at least one outer edge extending therearound, at least first and second adjacent sides and at least a first corner formed by the intersection of the first and second adjacent sides. A plurality of berm members is configured to be positioned at least partially around the perimeter of the load-supporting surface proximate to at least a portion of the outer edge(s) of the perimeter of the load-supporting surface and extend upwardly relative to the-mats. The berm members are configured to prevent liquid disposed upon the upper surface of the load-supporting surface from leaking off of the load-supporting surface. At least one berm member is formed in an angular shape and configured to be positioned along the first corner of the perimeter and at least one berm member is arranged and adapted to be driven over by and withstand the weight of vehicles moving onto and off of the mats. At least some of the berm members includes front and rear portions each having a respective bottom surface, wherein the at least part of the bottom surface of the front portion is higher relative to at least part of the bottom surface of the rear portion.

The present disclosure includes embodiments of an outdoor work-site liquid collection system that includes a load-supporting surface having an upper surface and including at least two mats forming a perimeter thereof. The load-supporting surface is arranged and adapted to support the weight of people, vehicles and equipment thereupon. A plurality of berm members is configured to be positioned at least partially around the perimeter of the load-supporting surface and extend upwardly relative to the mats. Each berm member is configured to releasably sealing engage the load-supporting surface to prevent liquid disposed upon the upper surface thereof from leaking off of the load-supporting surface at the respective berm member.

At least one liquid drain assembly includes at least one elongated drain channel member and at least one drain outlet member. Each drain channel member is configured to be disposed between an adjacent pair of mats in the load-supporting surface. The drain channel member(s) include first and second ends and at least one liquid passageway extending at least partially therebetween and recessed relative to the upper surface of the load-supporting surface. The liquid passageway(s) are configured to collect liquid introduced onto the load-supporting surface and direct liquid off of the load-supporting surface to provide controlled drainage of liquid from the load-supporting surface. The drain outlet member(s) are configured to be disposed proximate to at least one among the first and second ends of the at least one drain channel member and include a spout in liquid communication with one or more of the liquid passageways. The spout(s) are configured to allow liquid to flow from the at least one liquid passageway off of the load-supporting surface.

In some embodiments, the present disclosure involves a system for preventing the leakage of liquid from a reusable, load-supporting surface deployed on the ground without the use of any liners beneath the load-supporting surface. The load-supporting surface includes at least two interconnected planar mats forming a perimeter thereof. Each mat is constructed of impermeable plastic and includes a plurality of locking pin holes each configured to accept a locking pin therethrough. The perimeter of the load-supporting surface includes at least four sides, at least first and second perimeter sides having an upper lip extending horizontally outwardly therefrom and spaced above the ground, and at least third and fourth perimeter sides having a lower lip extending horizontally outwardly therefrom and resting on the ground.

The system includes a plurality of spacers and berm members. Each spacer is planar and constructed of impermeable plastic. Each spacer has a first section configured to be positioned on the ground below the upper lip of a portion of at least one among the first and second perimeter sides of the load-supporting surface, and a second section extending horizontally outwardly therefrom beyond the adjacent upper lip. Each spacer includes a plurality of locking pin holes, at least one of which is configured to be aligned beneath a locking pin hole of an adjacent mat and accept a locking pin therethrough for releasably securing them together.

Each berm member includes first and second ends and is constructed of impermeable plastic. The berm members are positionable around the perimeter of the load-supporting surface. Each berm member includes at least one horizontal base having front and rear edges extending between the ends of the berm member, and at least one vertical wall extending upwardly from the horizontal base proximate to the front edge thereof. Each berm member is configured so that its horizontal base is positionable atop and releasably engageable with the second section of at least one spacer and/or at least one lower lip of the third or fourth perimeter sides of the load-supporting surface. The base includes a plurality of locking pin holes, at least one of which is alignable over at least one locking pin hole of the spacer or lower lip it rests atop and accepts a locking pin therethrough for releasably securing them together. Each berm member on the perimeter of the load-supporting surface sealingly, releasably engages each adjacent berm member and the load-supporting surface to prevent the leakage of liquid from the load-supporting surface around its perimeter without the use of any liners beneath the load-supporting surface.

In many embodiments, the present disclosure involves a modular system for containing and draining liquid introduced onto a reusable, load-supporting surface without the use of any liners beneath the load-supporting surface. The load-supporting surface includes at least two planar mats forming a perimeter thereof. Each mat is constructed of impermeable plastic. The system includes a plurality of releasably, sealingly interconnected berm members configured to releasably, sealingly engage the load-supporting surface around its perimeter to prevent leakage of liquid from the load-supporting surface around its perimeter without the use of any liners beneath the load-supporting surface. Each berm member is constructed of impermeable plastic and includes first and second ends and at least one integrally formed horizontal base and vertical wall. The horizontal base and vertical wall extend from the first end to the second end of the berm member. Each berm member sealingly engages the adjacent berm members around the perimeter of the load-supporting surface sufficient to contain liquid introduced onto the load-supporting surface to the full height of the vertical wall thereof.

The system also includes at least one elongated drain channel constructed of impermeable plastic and configured to extend across the length of the load-supporting surface between adjacent mats on its sides and opposing berm members at its ends. Each drain channel includes at least one fluid passageway extending along the length thereof. The drain channel collects fluid introduced onto the load-supporting surface and directs it off the load-supporting surface. The drain channel, or series of aligned drain channels, releasably sealingly engages the adjacent mats and opposing berm members.

Accordingly, the present disclosure includes features and advantages which are believed to enable it to advance load-supporting surface technology. Characteristics and advantages of the present disclosure described above and additional features and benefits will be readily apparent to those skilled in the art upon consideration of the following detailed description of various embodiments and referring to the accompanying drawings.

BRIEF DESCRIPTION OF THE DRAWINGS

The following figures are part of the present specification, included to demonstrate certain aspects of various embodiments of this disclosure and referenced in the detailed description herein:

FIG. 14 is a partial perspective view of various components of the liquid drain assembly of FIG. 11;

FIG. 15 is a perspective view of an exemplary gasket useful in liquid containment systems in accordance with the present disclosure;

FIG. 16 is a perspective view of another exemplary gasket useful in liquid containment systems in accordance with the present disclosure; and FIG. 17 is a perspective view of another exemplary gasket useful in liquid containment systems in accordance with the present disclosure.

DETAILED DESCRIPTION OF PREFERRED EMBODIMENTS

Figure 1:
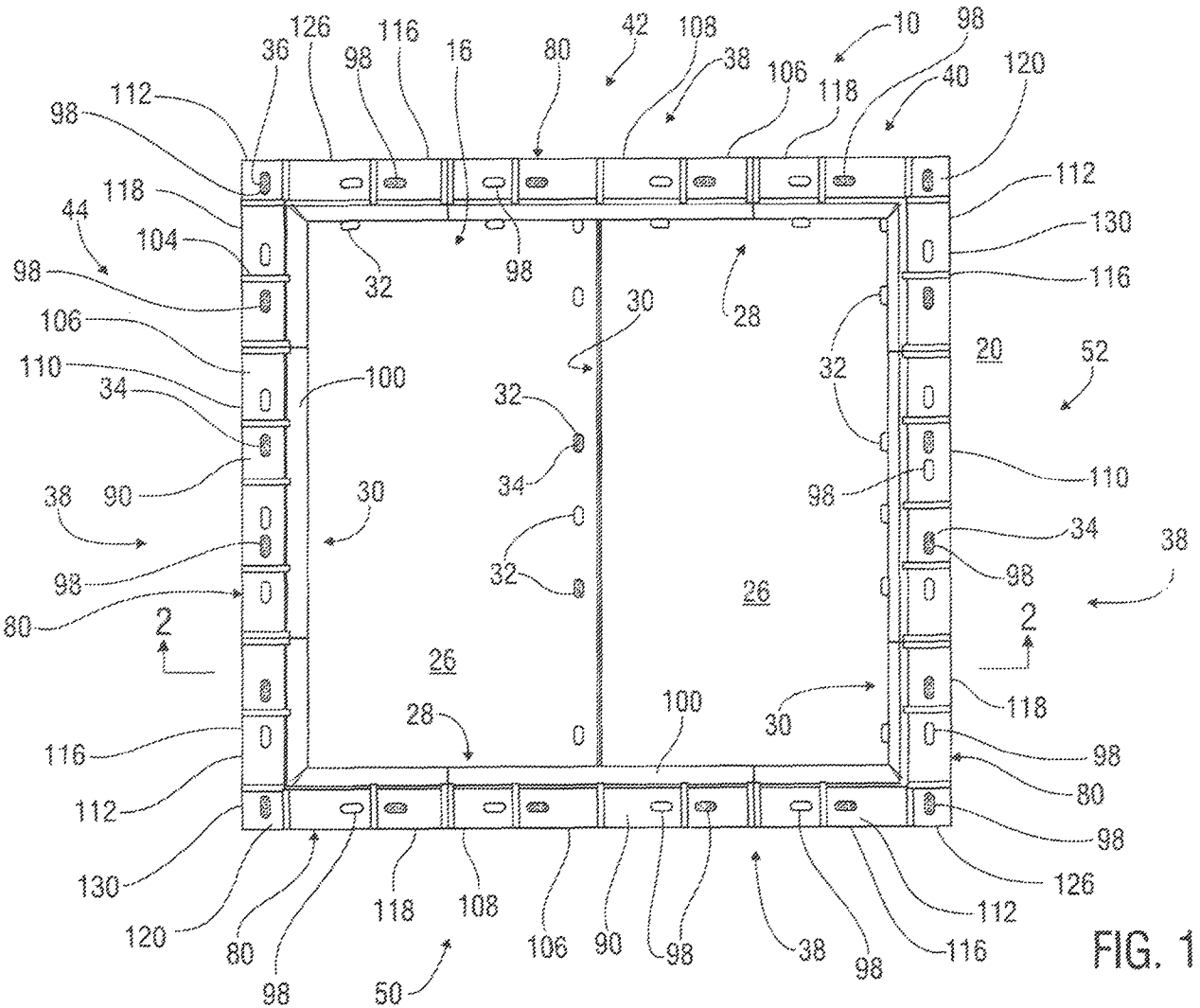
FIG. 1 is a top view of an embodiment of a liquid containment system in accordance with the present disclosure shown disposed around an exemplary load-supporting surface.

Characteristics and advantages of the present disclosure and additional features and benefits will be readily apparent to those skilled in the art upon consideration of the following detailed description of exemplary embodiments of the present disclosure and referring to the accompanying figures. It should be understood that the description herein and appended drawings, being of example embodiments, are not intended to limit the claims of this patent or any patent or patent application claiming priority hereto. On the contrary, the intention is to cover all modifications, equivalents and alternatives falling within the spirit and scope of the claims. Many changes may be made to the particular embodiments and details disclosed herein without departing from such spirit and scope.

In showing and describing preferred embodiments in the appended figures, common or similar elements are referenced with like or identical reference numerals or are apparent from the figures and/or the description herein. The figures are not necessarily to scale and certain features and certain views of the figures may be shown exaggerated in scale or in schematic in the interest of clarity and conciseness.

As used herein and throughout various portions (and headings) of this patent application, the terms "invention", "present invention" and variations thereof are not intended to mean every possible embodiment encompassed by this disclosure or any particular claim(s). Thus, the subject matter of each such reference should not be considered as necessary for, or part of, every embodiment hereof or of any particular claim(s) merely because of such reference. The terms "coupled", "connected", "engaged" and the like, and variations thereof, as used herein and in the appended claims are intended to mean either an indirect or direct connection or engagement. Thus, if a first device couples to a second device, that connection may be through a direct connection, or through an indirect connection via other devices and connections.

Certain terms are used herein and in the appended claims to refer to particular components. As one skilled in the art will appreciate, different persons may refer to a component by different names. This document does not intend to distinguish between components that differ in name but not function. Also, the terms "including" and "comprising" are used herein and in the appended claims in an open-ended fashion, and thus should be interpreted to mean "including, but not limited to . . . ." Further, reference herein and in the appended claims to components and aspects in a singular tense does not necessarily limit the present disclosure or appended claims to only one such component or aspect, but should be interpreted generally to mean one or more, as may be suitable and desirable in each particular instance.

Figure 2:
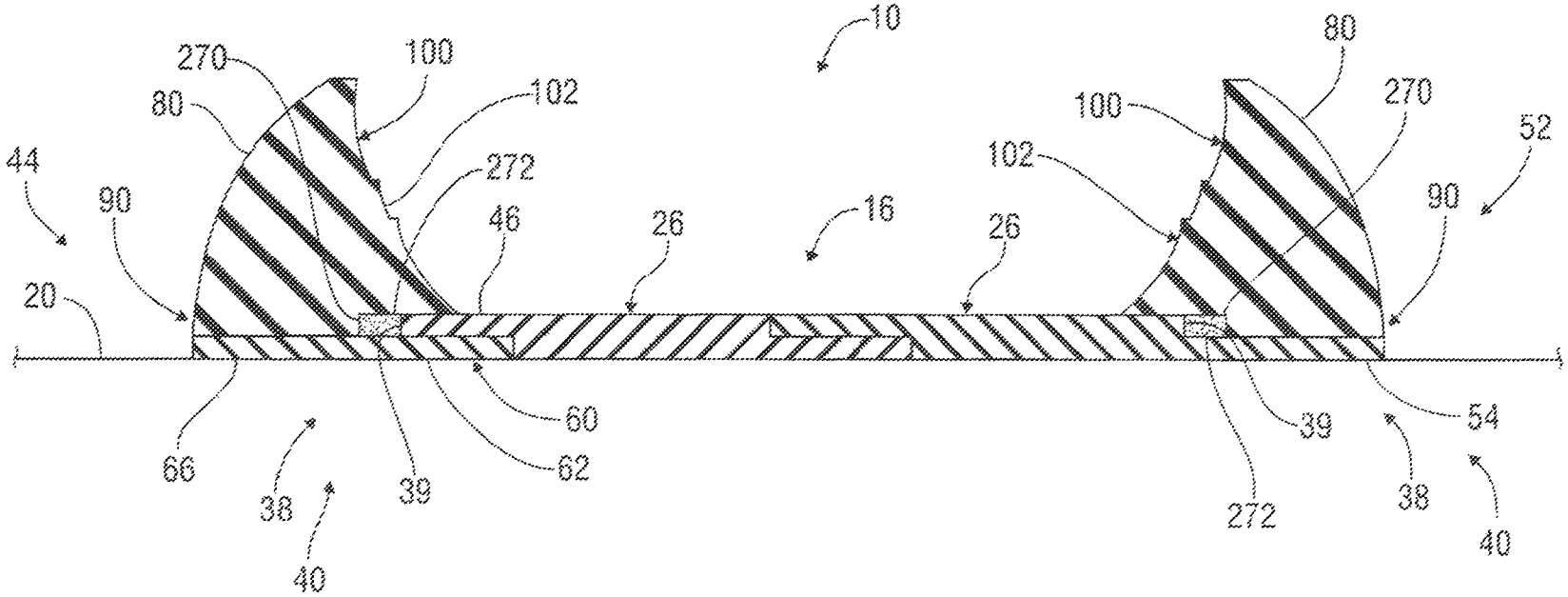
FIG. 2 is a cross-sectional view of the liquid containment system and load-supporting surface of FIG. 1 taken along lines 2-2.

Referring initially to FIGS. 1 and 2, a liquid containment system 10 for containing liquid on a load-supporting surface 16 deployed on the ground 20 or other surface is shown. The illustrated load-supporting surface 16 includes at least two interconnected mats 26 forming a perimeter 40 thereof. The perimeter 40 of the exemplary load-supporting surface 16 includes at least four sides 38 and an edge 39 (FIG. 2) extending at least partially around each side 38.

In this particular example, at least first and second perimeter sides 42, 44 have an upper lip 46 extending horizontally outwardly therefrom and spaced above the ground 20 (or other surface). At least third and fourth perimeter sides 50, 52 have a lower lip 54 extending horizontally outwardly therefrom and resting on the ground 20 (or other surface). When included, the upper and lower lips 46, 54 may have any suitable size, shape, configuration and length. In this example, the upper and lower lips 46, 54 are formed on the adjacent mats 26, such as shown and described in U.S. Pat. No. 5,653,551 to Seaux, entitled "Mat System for Construction of Roadways and Support Surfaces" and issued on Aug. 5, 1997, and U.S. Pat. No. 6,511,257 to Seaux et al., entitled "Interlocking Mat System for Construction of Load Supporting Surfaces" and issued on Jan. 28, 2003, both of which have a common Assignee as the present patent and the entire contents of which are hereby incorporated by reference herein in their entireties. However, the liquid containment system 10 of the present disclosure is not limited to use with load-supporting surfaces 16 having upper and lower lips 46, 54. Other embodiments may be used with load-supporting surfaces 16 not having upper and/or lower lips 46, 54 around their perimeters 40.

The mats 26 may have any suitable form, construction and configuration. Some examples of mats 26 which may be used in various embodiments of the present disclosure are shown and described in U.S. Pat. Nos. 5,653,551 and 6,511,257. For example, the mats 26 may be 14'×8' DURA-BASE® mats currently sold by the Assignee of this patent. In this example, each mat 26 is flat, or planar, and constructed of impermeable material, such as thermoplastic material. The exemplary mats 26 have a rectangular shape with opposing pair of short sides 28 (e.g. FIG. 4) and an opposing pair of long sides 30 (e.g. FIG. 4), and are shown in FIG. 1 arranged lengthwise relative to one another to form the load-supporting surface 16. Thus, the illustrated first and third perimeter sides 42, 50 of the load-supporting surface 16 are formed by the short side(s) 28, and the second and fourth perimeter sides 44, 52 are formed by the long side(s) 30 of one or multiple adjacent mats 26. However, the present disclosure is not limited to this arrangement of mats 26. The mats 26 may be arranged in any desired configuration.

In some embodiments, a "mat-to-mat seal" (not shown) may be used between adjacent mats 26 and between various components of the system 10 described below, such as to provide a fluid-tight seal therebetween. Some example of mat-to-mat seals that may be used in connection with various embodiments of the present disclosure are shown and described in U.S. Provisional Patent Application Ser. No. 61/621,898, entitled "Method of Producing Impermeable Temporary Load Bearing Surfaces" and filed on Apr. 9, 2012, and U.S. patent application Ser. No. 13/803,580, entitled "Apparatus and Methods for Sealing Between Adjacent Components of a Load-Supporting Surface", and filed on Mar. 14, 2013, both of which have a common Assignee as the present patent and the entire contents of which are hereby incorporated by reference herein in their entireties.

Figure 4:
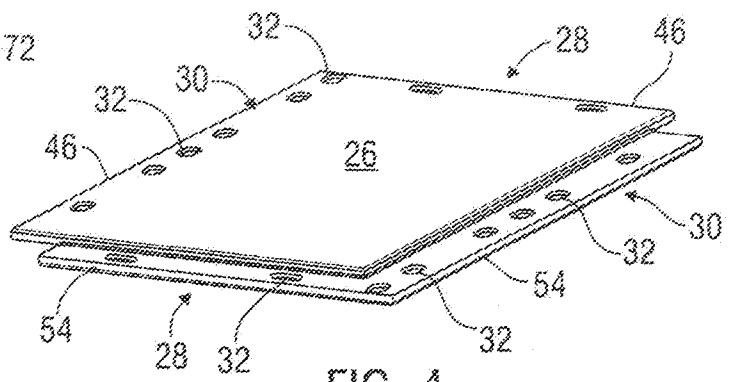
FIG. 4 is a perspective view of an exemplary mat useful in the load-supporting surface of FIG. 1.

Referring specifically to FIG. 1, the illustrated mats 26 include a plurality of locking pin holes 32, each configured to accept a releasable locking pin 34 therethrough. For example, in some embodiments, such as shown in FIG. 4, each mat 26 may include a total of sixteen locking pin holes 34, eight formed in each of the upper and lower lips 46, 54. The locking pins 34 and locking pin holes 32 may have any suitable form, construction and configuration. In some embodiments, the locking pins 34 may form a fluid-tight seal around or in the locking pin holes within which they are engaged. Some examples of locking pins 34 which may be used in various embodiments of the present disclosure are shown and described in U.S. Pat. No. 6,722,831 to Rogers et al, entitled "Fastening Device" and issued on Apr. 20, 2004, U.S. Provisional Patent Application Ser. No. 61/748,818, entitled "Apparatus and Methods for Connecting Mats" and filed on Jan. 4, 2013, and U.S. patent application Ser. No. 13/780,350, entitled "Apparatus and Methods for Connecting Mats" and filed on Feb. 28, 2013, all of which have a common Assignee as the present patent and the entire contents of which are hereby incorporated by reference herein in their entireties. In the illustrated example, the locking pin holes 32 of the mats 26 have an oval-shape to accept an oval-shaped enlarged head 36 of the illustrated locking pins 34. It should be noted, however, that the present disclosure is not limited to use with the above-described or referenced types or configurations of load-supporting surfaces 16, mats 26, locking pins 34 and locking pin holes 32, or to the disclosures of the above-referenced patents and patent applications. Any suitable load-supporting surfaces 16, mats 26, locking pins 34 and locking pin holes 32 may be used.

Now in accordance with one aspect of the present disclosure, referring again to FIGS. 1 and 2, the liquid containment system 10 includes a plurality of berm members 80 and may include a plurality of spacers 60 (FIG. 2). The exemplary berm members 80 are positionable around the perimeter 40 of the load-supporting surface 16 and abut its edge 39. The spacers 60, when included, are used around the sides 38 of the perimeter 40 that have an upper lip 46. In this embodiment, that includes perimeter sides 42, 44 (see FIG. 3).

The spacers 60 and berm members 80 may have any suitable form, configuration, construction and operation. Each spacer 60 of this embodiment is flat, or planar, and constructed of impermeable material, such as thermoplastic material. As shown in FIG. 2, the illustrated spacers 60 fit in the space below the upper lip 46, and provide surfaces upon which the berm members 80 may be placed. In this regard, each exemplary spacer 60 can be said to have a first section 62 configured to be positioned on the ground 20 (or other surface) below the upper lip 46 of a portion of the first and/or second perimeter sides 42, 44 of the load-supporting surface 16, and a second section 66 extending horizontally outwardly therefrom beyond the adjacent upper lip 46.

Figure 3:
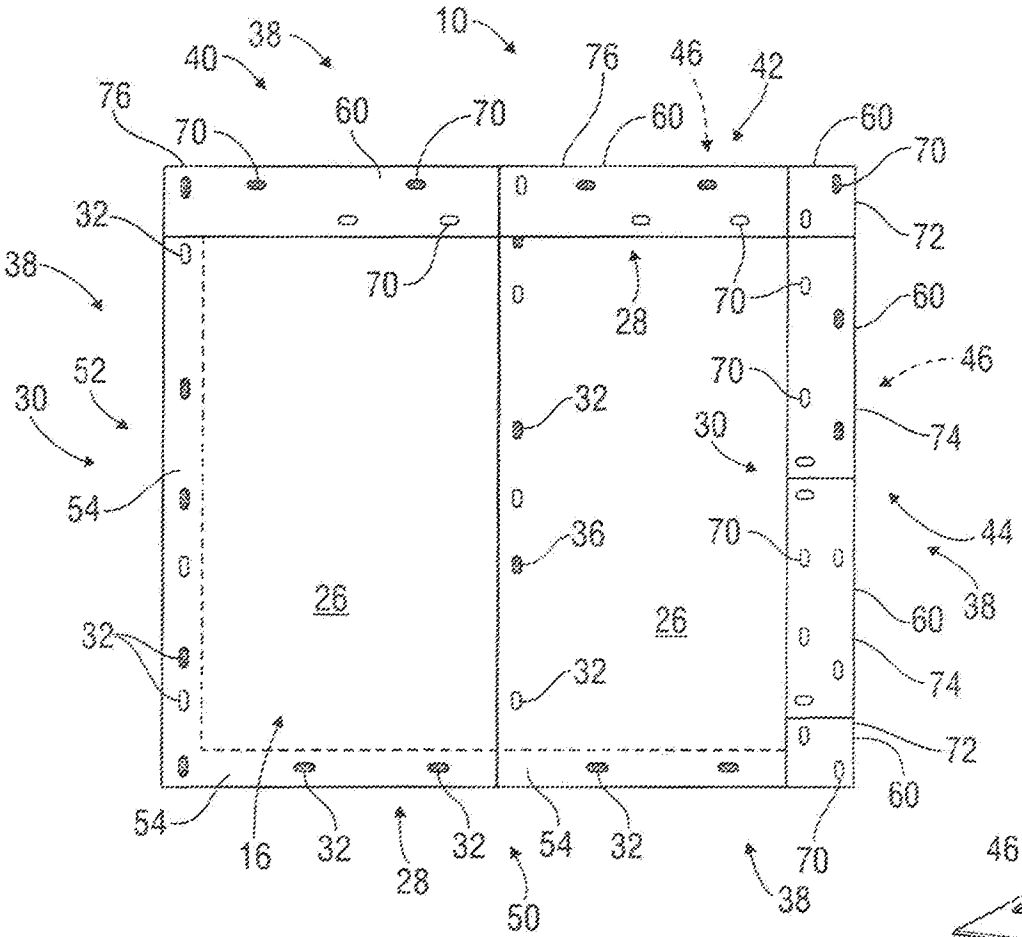
FIG. 3 is a bottom view of the liquid containment system and load-supporting surface of FIG. 1.

As shown in FIG. 3, each exemplary spacer 60 includes a plurality of locking pin holes 70. When a spacer 60 is emplaced in the perimeter 40 of the exemplary load-supporting surface 16, at least one of the locking pin holes 70 aligns beneath a locking pin hole 32 of at least one adjacent mat 26 and accepts a locking pin 34 therethrough for releasably securing them together. Likewise, at least one of the illustrated locking pin holes 70 will align beneath at least one locking pin hole 98 (FIG. 1) of at least one adjacent berm member 80 and accept a locking pin 34 therethrough for releasably securing them together.

Figure 5B:
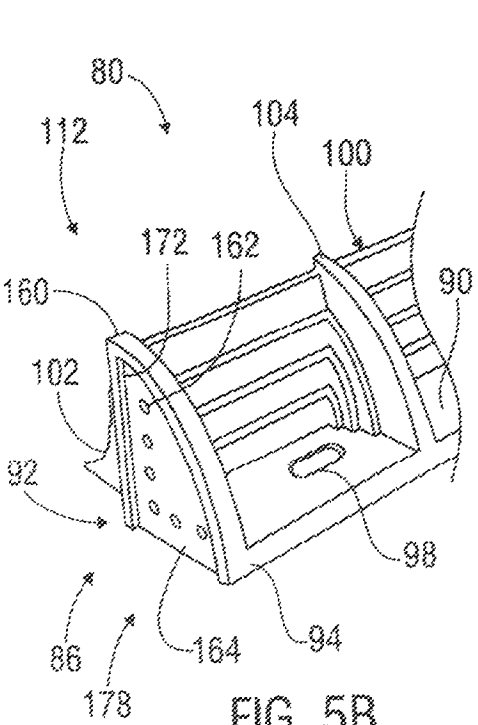
FIG. 5B is a partial perspective view of an embodiment of an exemplary berm member useful in liquid containment systems in accordance with the present disclosure.
Figure 5A:
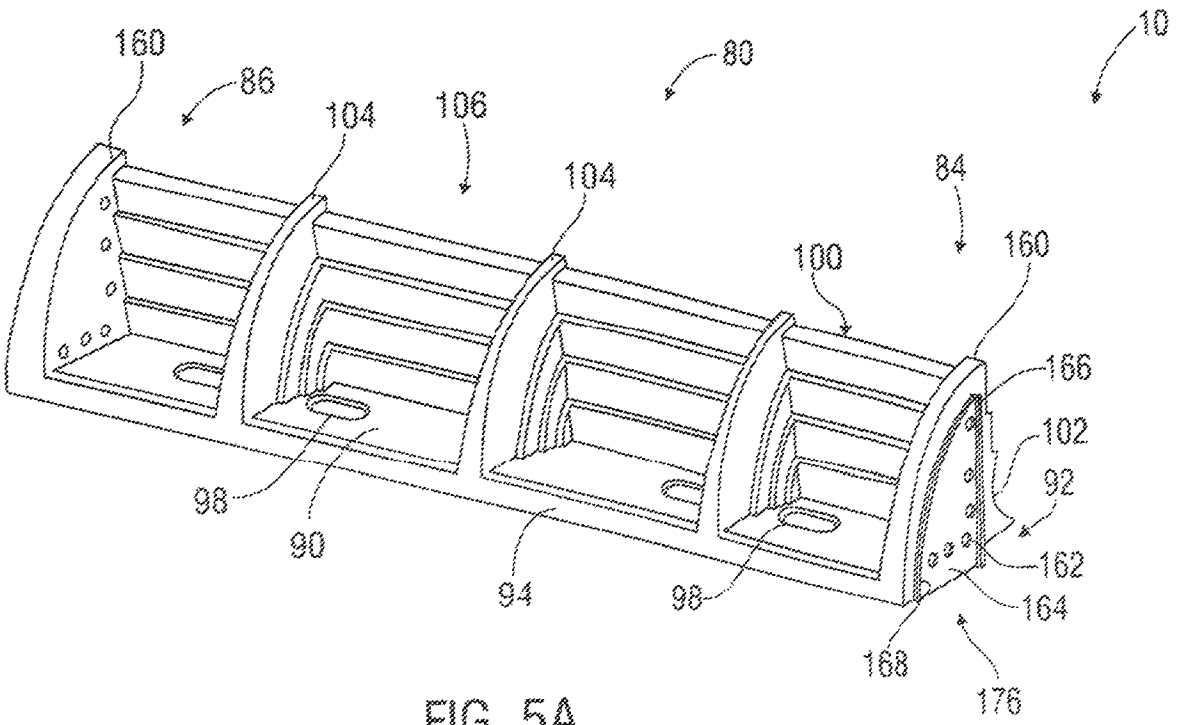
FIG. 5A is a partial perspective view of an embodiment of an exemplary berm members useful in liquid containment systems in accordance with the present disclosure.

Referring to FIGS. 5A-B, the berm members 80 of this embodiment each have first and second ends 84, 86 and are also constructed of impermeable material, such as thermoplastic. Each exemplary berm member 80 includes at least one horizontal base 90 and at least one vertical wall 100. The base 90 and wall 100 may have any suitable form, configuration and operation. In this embodiment, the base 90 includes front and rear edges 92, 94 extending between the ends 84, 86 of the berm member 80. The illustrated base 90 is configured to be positioned atop and engageable with the second section 66 (e.g. FIG. 2) of at least one spacer 60 or at least one lower lip 54 (e.g. FIG. 2) on the perimeter 40 of the load-supporting surface 16. Each exemplary horizontal base 90 includes a plurality of oval-shaped locking pin holes 98, at least one of which aligns over a locking pin hole 70 (FIG. 3) of the adjacent spacer(s) 60 or a locking pin hole 32 (FIG. 1) of the adjacent lower lip(s) 54, and accepts a locking pin 34 therethrough for releasably securing them together. In some applications, at least two locking pins 34 are used to secure each berm member 80.

Still referring to FIGS. 5A-B, the illustrated vertical wall 100 extends upwardly from the base 90 proximate to its front edge 92 and along the length thereof. In this embodiment, the vertical wall 100 has a sufficient height to contain a pre-established maximum amount of liquid (not shown) that may be spilled or otherwise collected on the load-supporting surface 16 (e.g. rainwater). For example, the vertical walls 100 may, in some embodiments, extend upwardly to a height over the load-supporting surface 16 of at least 12 inches. In this embodiment, the vertical wall 100 includes numerous back supports 104, such as to give rigidity to the berm member 80 and/or provide stiffness to the wall 100. The exemplary wall 100 has a generally inwardly, downwardly sloping front surface 102. This may be useful, for example, to enhance the load-bearing capacity of the berm members 80 as liquid may rise on the load-supporting surface 16. For another example, as liquid rises on the load-supporting surface 16, the curved shape of the front surface 102 may allow the fluid pressure acting on the wall 100 to promote sealing engagement of the berm members 80 and the mats 26.

Figure 7A:
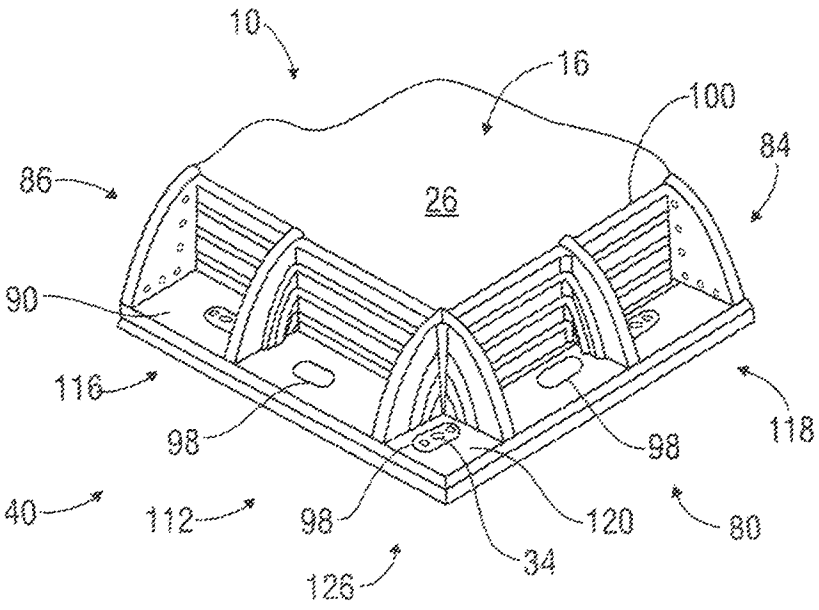
FIG. 7A is a perspective view of an exemplary corner berm member useful in liquid containment systems in accordance with the present disclosure.

Referring back to FIG. 1, in another independent aspect of the present disclosure, the liquid containment system 10 may include different types of berm members 80 disposed around the perimeter 40. In this embodiment, the system 10 includes linear berm members 106 and corner berm members 112. The exemplary linear berm members 106 are elongated (see FIG. 5A), having a horizontal base 90 and vertical wall 100 that extend lengthwise from the first end 84 to the second end 86 thereof. The corner berm members 112 are configured to be positioned on the perimeter corners of the load-supporting surface 16. Each illustrated corner berm member 112 has left and right elongated portions 116, 118 extending angularly outwardly from a center portion 120 thereof at a ninety degree angle (see FIGS. 7A and 7B). For reference, the "left" and "right" designations of the portion 116, 118 are taken from the perspective of facing the load-supporting surface 16.

Referring still to FIG. 1, in some embodiments, the system 10 may include different types of linear berm members 106 and corner berm members 112. In this embodiment, the linear berm members 106 include short side, or first, linear berm members 108 and long side, or second, linear berm members 110. The illustrated first linear berm member 108 includes four linearly aligned locking pin holes 98 and is longer than the second linear berm member 110, which includes five linearly aligned locking pin holes 98. In this embodiment, the first linear berm members 108 are positionable on sides of the load-supporting surface 16 having the short side(s) 28 of the mat(s) 26 (e.g. the first and third perimeter sides 42, 50). The exemplary second linear berm members 110 are positionable on sides of the load-supporting surface 16 having the long side(s) 30 of the mat(s) 26 (e.g. second and fourth perimeter sides 44, 52).

The illustrated embodiment also includes different types of corner berm members 112: long-to-short-side corner berm members 126 and short-to-long-side corner berm members 130. The exemplary long-to-short side (first) corner berm members 126 are configured so that their left elongated portions 116 are positioned on the sides of the load-supporting surface 16 having the short side(s) 28 of the mat(s) 26. In the illustrated example, these are the first and third perimeter sides 42, 50. The exemplary short-to-long-side (second) corner berm members 130 are positioned on the other corners of the load-supporting surface 16, so their left elongated portions 116 are positioned on the sides of the load-supporting surface 16 having the long side(s) 30 of the mat(s) 26. In the illustrated example, these are the second and fourth perimeter sides 44, 52. In this embodiment, the left elongated portion 116 of the second corner berm member 130 is longer than its right elongated portion 118 and both portions 116, 118 of the first corner berm member 126. The right elongated portion 118 of the exemplary second corner berm member 130 is the shortest of the four respective elongated portions, and the left elongated portion 116 of the first corner berm member 126 is shorter than its right elongated portion 118.

Still referring to FIG. 1, in this embodiment, the first and second corner berm members 126, 130 each include two linearly aligned locking pin holes 98 formed in each of the left and right elongated portions 116, 118, and an additional locking pin hole 98 formed in the center portion 120 thereof. However, the exemplary locking pin hole 98 in the center portion 120 of the first corner berm member 126 is linearly aligned with the locking pin holes 98 of the right elongated portion 118 (see also FIG. 7A), while the locking pin hole 98 in the center portion 120 of the second corner berm member 130 is linearly aligned with the locking pin holes 98 of the left elongated portion 116 thereof.

Figure 7B:
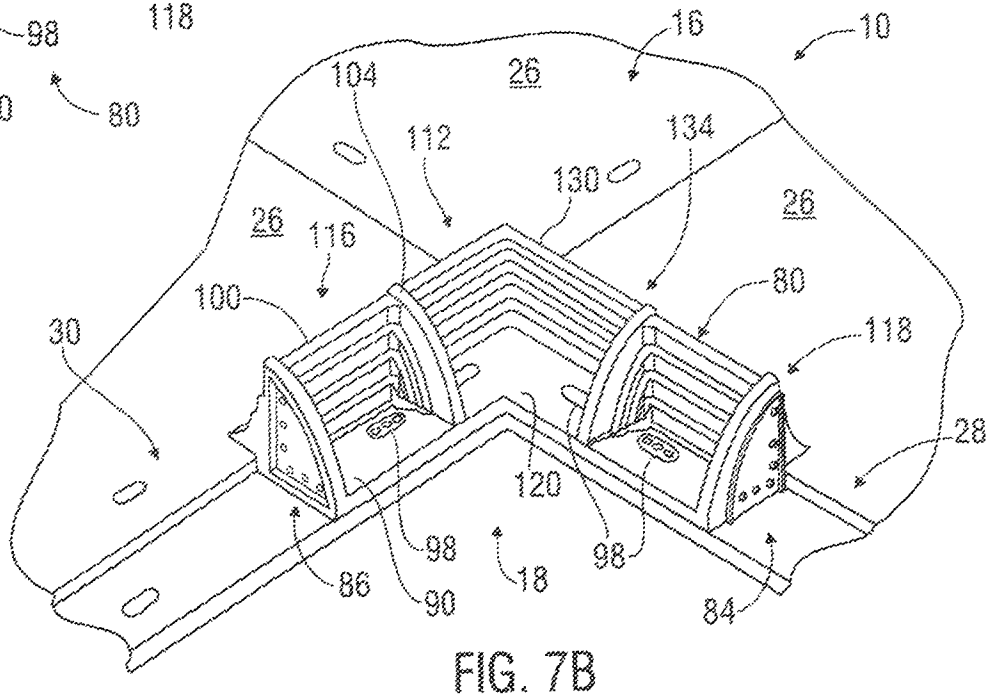
FIG. 7B is a perspective view of an exemplary inside corner berm member useful in liquid containment systems in accordance with the present disclosure.

Referring to FIG. 7B, in some embodiments, there may be a need for another type of corner berm member 112, an inside corner berm member 134. For example, inside corner berm members 134 may be useful when the load-supporting surface 16 includes an inside corner 18, such as when the perimeter 40 is not formed in the shape of a single rectangle. The inside corner berm members 134 may have any suitable form, configuration and operation. In this embodiment, the inside corner berm member 134 include left and right elongated portions 116, 118 that extend angularly backwardly from the center portion 120 and have only one locking pin hole 98 formed therein. The exemplary center portion 120 has two locking pin holes 98, one aligned with each locking pin hole 98 of the left and right elongated portions 116, 118. If desired, the inside corner berm members 134 may come in two varieties, similarly as described above with respect to the first and second corner berm members 126, 130. Otherwise, the illustrated inside corner berm members 134 have the same features as the other corner berm members 112 described above.

In another aspect of the present disclosure, referring back to FIG. 3, the liquid containment system 10 may include different types of spacers 60. For example, the system 10 may include corner spacers 72, long spacers 74 and short spacers 76. In this embodiment, the corner spacers 72 have a square shape and are used in the two corners of the perimeter 40 not having a lower lip 54 (FIG. 2). The exemplary long spacers 74 have a length that is greater than that of the short spacers 76 and are used on the side 38 of the perimeter 40 having an upper lip 46 and formed by the long side(s) 30 of one or multiple adjacent mats 26 (the second perimeter side 44). The illustrated short spacers 76 are used on the side 38 of the perimeter 40 having an upper lip 46 and formed by the short side(s) 28 of one or multiple adjacent mats 26 (the first perimeter side 42). Depending upon the configuration of the load-supporting surface 16 and liquid containment system 10, the spacers 72, 74 and 76 may be used in additional locations. For example, a corner spacer 72 may be used in the embodiment shown in FIG. 11 below the center of the illustrated fourth linear berm member 226.

In another independent aspect of the present disclosure, adjacent berm members 80 may be releasably connectable in any suitable manner. For example, in FIGS. 5A-B, each berm member 80 includes an end support 160 at each end 84, 86 thereof. The end supports 160 may have any suitable form, configuration and operation. In this embodiment, each end support 160 extends across the width of the horizontal base 90 from the vertical wall 100 to the rear edge 94 of the horizontal base 90.

Figures 6A, 6B:
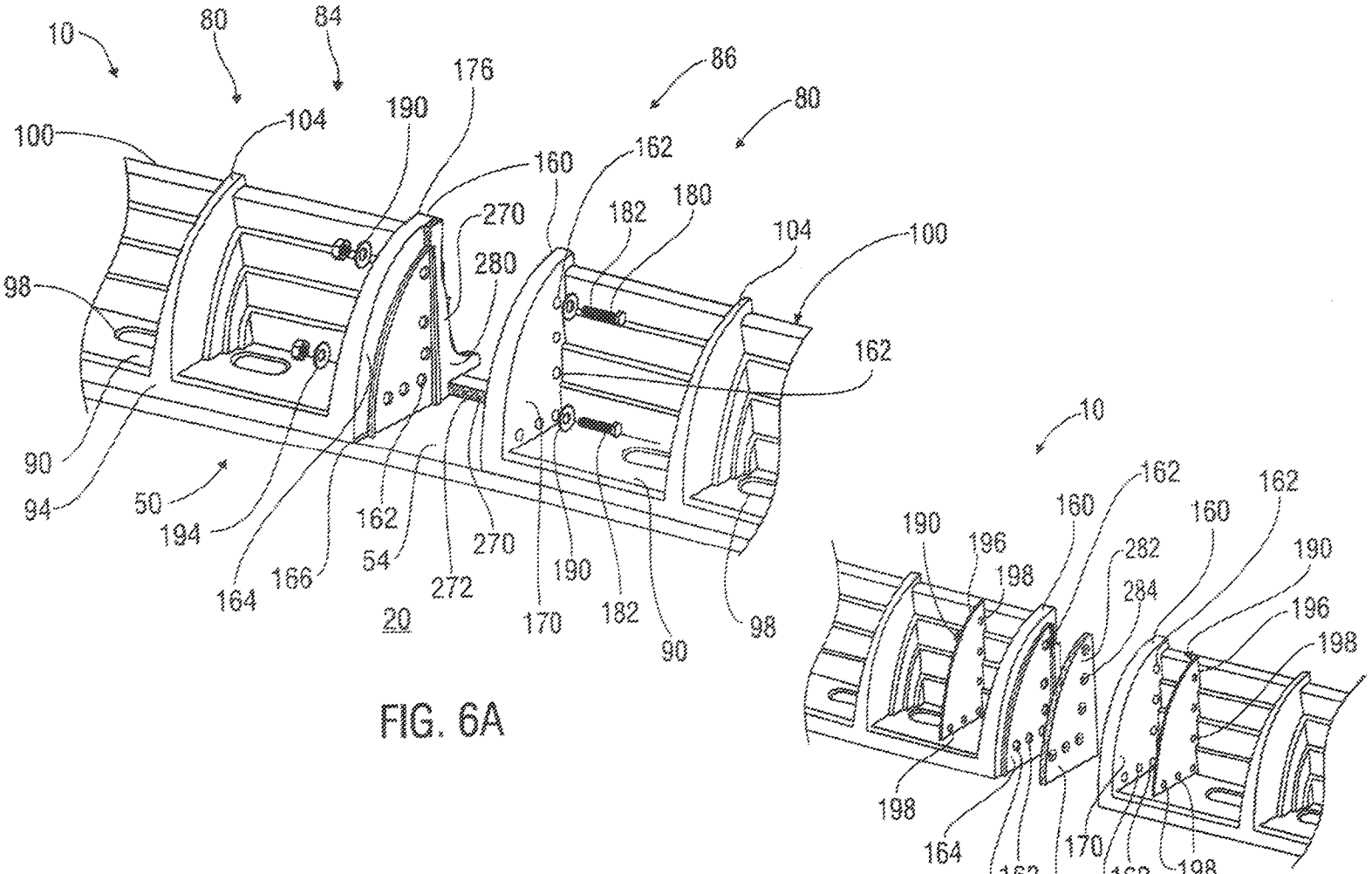
FIG. 6A is a partial perspective view of two exemplary berm members with exemplary connecting and sealing components shown prior to being connected together and useful in liquid containment systems in accordance with the present disclosure.
FIG. 6B is a partial perspective view of two exemplary berm members with other exemplary connecting and sealing components shown prior to being connected together and useful in liquid containment systems in accordance with the present disclosure.

The exemplary end support 160 includes an outer face 164 disposed on the outwardly facing side thereof, and an inner face 170 on the opposite side thereof (FIG. 6A). At one end of each berm member 80 (e.g. the first end 84), the illustrated outer face 164 includes at least one protrusion 166 extending outwardly therefrom. The end support 160 having the protrusion 166 is referred to herein as the first end support 176. At the other end of each exemplary berm member 80 (e.g. the second end 86), the outer face 164 of the end support 160 includes at least one recess 172 formed therein. The end support 160 having the recess 172 is referred to herein as the second end support 178. Accordingly, the protrusion(s) 166 on the outer face 164 of the first end support 176 of one berm member 80 will matably engage the recess(es) 172 on the outer face 164 of the second end support 178 of an adjacent berm member 80 on the perimeter 40 of the load-supporting surface 16.

The protrusion 166 and recess 172 may have any desired configuration. In this embodiment, the protrusion 166 is a rib 168 and both the protrusion 166 and recess 172 are formed in the same overall shape as the end supports 160. This may be useful, for example, to form a tight sealing engagement between adjacent berm members 80.

Referring now to FIG. 6A, each illustrated end support 160 includes a plurality of laterally-oriented holes 162 formed therein for releasably engaging the end supports 160 together with of one or more releasable fasteners 180. The illustrated fasteners 180 are extendable through aligned holes 162 in the end supports 160 of adjacent berm members 80. Any desired number and configuration of holes 162 and fasteners 180 may be included. In this embodiment, six holes 162 are shown formed in an outwardly facing L-pattern in each end support 160. Six holes 162 may be optimal, for example, to effectively hold the berm members 80 together when subject to the hydrostatic forces of a maximum volume of liquid acting on the vertical walls 100. The illustrated fasteners are bolts 182. In this example, two bolts 182 are used. A six inch long, ½ diameter, bolt 182 is shown engageable through the innermost lower hole 162, and a five inch long, ½ diameter, bolt 182 is shown engaged through the innermost upper hole 162. However, any other suitable releasable fasteners 180 may be used, such as zip ties, quick-twist connectors and hitch pins. The use of fasteners 180 that are not as strong as bolts may warrant using more than two such fasteners.

Still referring to FIG. 6A, a load-spreading member 190 may be disposed between each fastener 180 and each end support 160, such as to spread the bearing load on the end support 160. For example, when the berm member 80 is constructed of plastic, it may be susceptible to deformation and weakening due to stress placed upon it from bearing loads at the fastener connection points. The load-spreading members 190 may have any suitable form, configuration and operation. In this embodiment, large diameter steel or aluminum washers 194 are used at each end of the fastener 180. For another example, in FIG. 6B, the load spreading members 190 include a pair of metal load-spreading plates 196. The illustrated load-spreading plates 196 include a plurality of holes 198 alignable over the holes 162 of the end support 160, and are configured to abut the inner face 170 of each connected end support 160.

Figure 9:
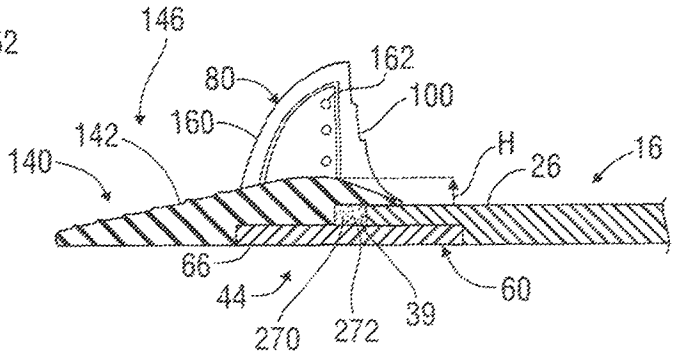
FIG. 9 is a partial cross-sectional view of the liquid containment system of FIG. 8 taken along lines 9-9.
Figure 8:
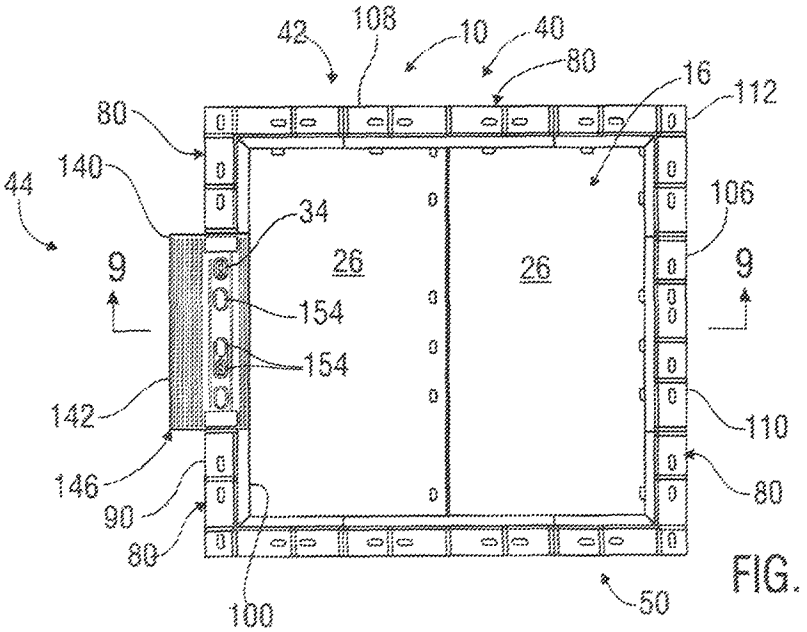
FIG. 8 is a top view of the exemplary liquid containment system of FIG. 1 including a drive-over barrier in accordance with an embodiment of the present disclosure.

Now referring to FIGS. 8 and 9, in another independent aspect of the present disclosure, the liquid containment system 10 may also include a berm member 80 in the form of one or more drive-over barriers 140 to be placed between other berm members 80 on the perimeter 40 of the load-supporting surface 16. For example, the illustrated drive-over barrier 140 allows vehicles (not shown) to be driven thereover for ingress onto and egress from the load-supporting surface 16.

The drive-over barriers 140 may have any suitable form, configuration and operation. In this embodiment, the drive-over barrier 140 is constructed of impermeable material, such as thermoplastic and includes an elongated, upwardly-angled ramp 142. In this example, the ramp 142 is wider than the horizontal base 90 of the other berm members 80, and reaches a height H above the load-supporting surface 16 sufficient to contain and prevent the leakage of a particular volume of fluid on the surface 16. For example, the height H of the ramp 142 may be at least three inches above the load-supporting surface 16.

Figure 10:
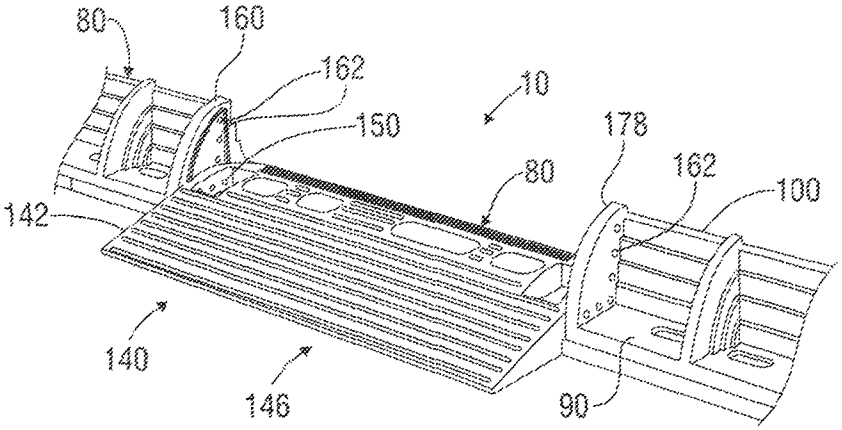
FIG. 10 is a perspective view of the exemplary drive-over barrier of FIG. 8.

When included, one or more drive-over barrier 140 can be added to or removed from the perimeter 40 of the load-supporting surface 16 as desired. In the embodiment of FIGS. 8-10, a long side, or second, drive-over barrier 146 having the same length as the second linear berm member 110 (FIG. 1) is used in its place on the perimeter 40. If desired, a short side, or first, drive-over barrier (not shown) having the same length as the first linear berm member 108 (FIG. 1) may be used in its place on the perimeter 40.

The illustrated drive-over barrier 140 is positionable on the perimeter 40 of the load-supporting surface 16 in the same way and location as the linear berm members 106, such as previously described with respect to FIG. 1. Thus, the drive-over barrier 140 is positionable atop and engageable with the second section 66 of at least one spacer 60, or at least one lower lip 54 at the third or fourth perimeter sides 50, 52. The illustrated barrier 140 includes at least one locking pin hole 154 alignable over at least one locking pin hole 70 of the adjacent spacer(s) 60, or at least one locking pin hole 32 on the adjacent lower lip(s) 54 of the load-supporting surface 16 to accept a locking pin 34 therethrough for releasably securing them together.

The exemplary drive-over barrier 140 may be configured to releasably engage the adjacent berm members 80 is any suitable manner. For example, referring to FIG. 10, the barrier 140 may include one or more holes 150 alignable with the holes 162 of the adjacent end supports 160 and through which the releasable fastener(s) 180 may be inserted. Otherwise, the drive over barrier 140 has the same features and liquid containment capabilities as the berm members 80.

Figure 11:
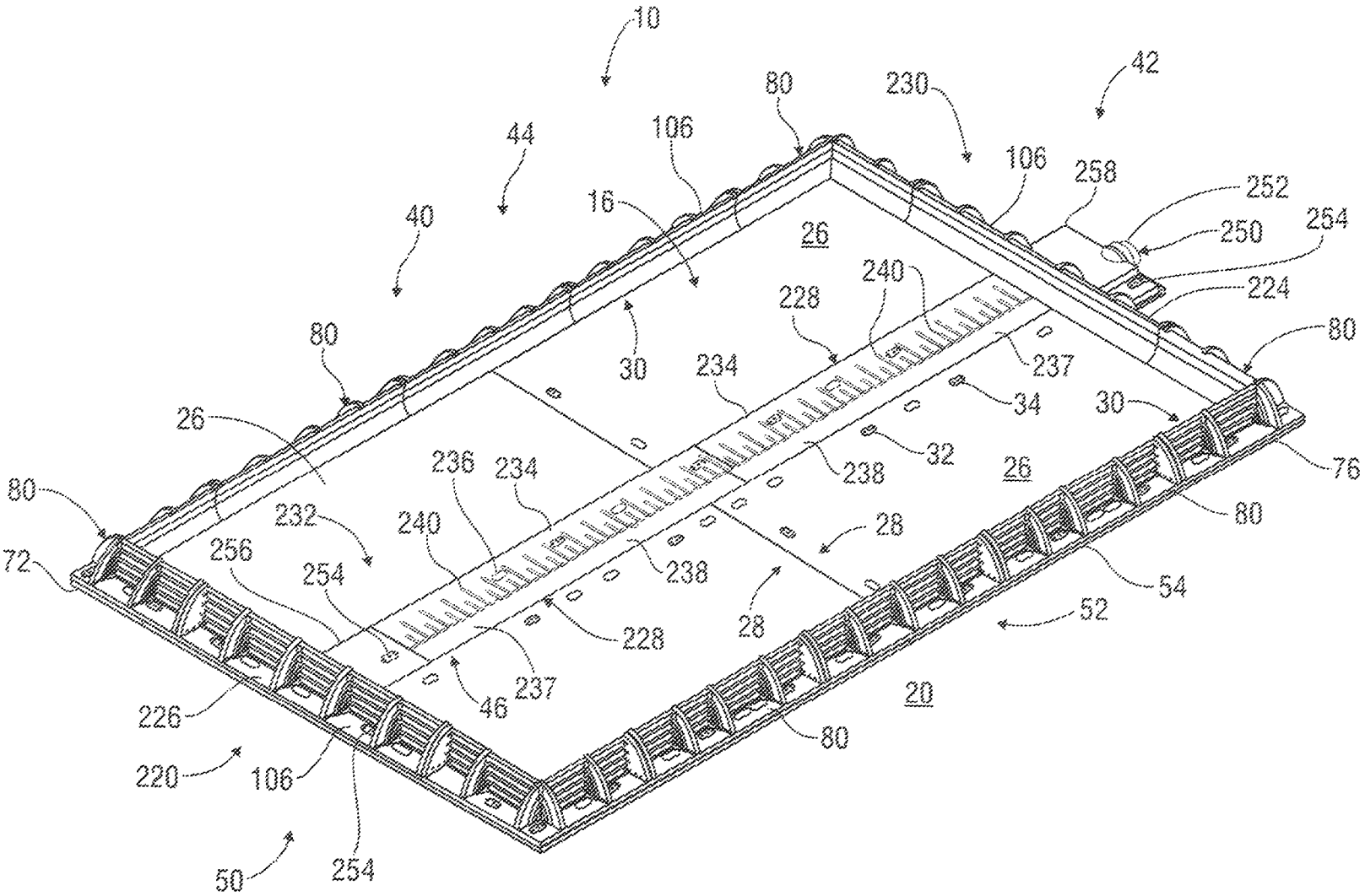
FIG. 11 is a top view of a liquid containment system having a liquid drain assembly shown used with an exemplary load-supporting surface in accordance with an embodiment of the present disclosure.
Figure 12:
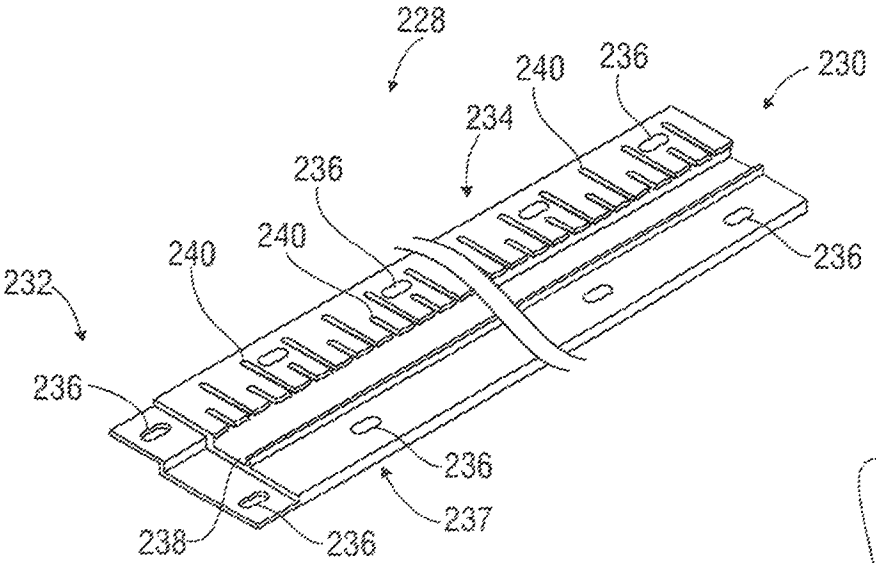
FIG. 12 is a perspective view of an exemplary drain channel of the liquid containment system of FIG. 11.

Now referring to FIGS. 11 and 12, in another independent aspect of the present disclosure, the liquid containment system 10 may include one or more liquid drain assemblies 220 configured to allow controlled drainage of liquid from the load-supporting surface 16. The liquid drain assembly 220 may have any suitable components, configuration and operation sufficient to allow drainage of fluid off of the load-supporting surface 16. In this embodiment, each assembly 220 including a pair of linear berm members 106, referred to herein as the third and fourth linear berm members 224, 226, and at least one elongated drain channel 228.

The berm members 224, 226 and drain channel 228 may have any suitable form, configuration and operation. Each illustrated drain channel 228 includes an elongated upper portion 234 and an elongated lower portion 237 extending along the length thereof. In this example, the lower portion 237 has at least one recessed fluid passageway 238 extending along its length. The fluid passageway 238 may have any desired configuration. In some embodiments, for example, the fluid passageway 238 may have a width of eight inches. If desired, the upper portion 234 may include a plurality of feed paths 240, each extending at least partially across the width thereof and terminating at the fluid passageway 238, to assist in allowing fluid on the load-supporting surface 16 to drain into the fluid passageway 238. Also if desired, the feed paths 240 may be angled downwardly toward the fluid passageway 238 to encourage fluid drainage from the load-supporting surface 16 thereto.

The exemplary drain channel 228 extends between the long sides 30 of adjacent mats 26 across the load-supporting surface 16 from the first to the third perimeter sides 42, 50. When the load-supporting surface 16 includes at least two mats 26 aligned at their short sides 28, the exemplary liquid drain assembly 220 includes at least two drain channels 228 axially aligned with one another so that their fluid passageways 238 are in fluid communication. In some embodiments, the terminal, or far, ends 230, 232 of the drain channel(s) 228 are offset relative to the first and third perimeter sides 42, 50 of the load-supporting surface 16. In the illustrated embodiment, the first terminal end 230 extends outward of the perimeter 40 and the second terminal end 232 is inward of the perimeter 40.

Still referring to FIGS. 11 and 12, each drain channel 228 is releasably connectable to adjacent components in any suitable manner. In this embodiment, the upper and lower portions 234, 237 of each drain channel 228 include a plurality of locking pin holes 236. At least one locking pin hole 236 on each illustrated portion 234, 237 aligns with at least one locking pin hole 32 of each adjacent mat 26, and accepts a locking pin 34 therethrough for releasably securing them together. The exemplary upper portion 234 is engageable with the lower lip 54 (FIG. 4) of one or more adjacent mat 26, and the lower portion 237 engages the upper lip 46 of one or more adjacent mat 26. In this embodiment, at least one locking pin hole 236 on each drain channel 228 is alignable with a locking pin hole 254 of the third or fourth linear berm members 224, 226 at the terminal ends 230, 232 of the drain channel(s) 228 and accepts a locking pin 34 therethrough for releasably securing them together.

Figure 13:
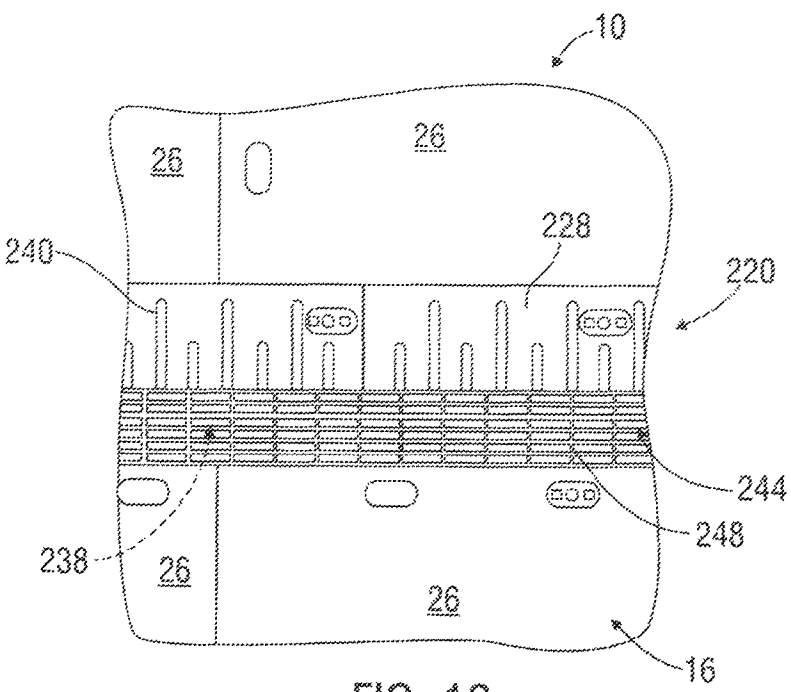
FIG. 13 is a top view of an exemplary cover useful with the exemplary drain channel of FIG. 11.

If desired, referring to FIG. 13, the liquid drain assembly 220 may include at least one elongated load-bearing cover 244 configured to be disposed over the fluid passageway(s) 238 of the drain channel(s) 228 to cover the fluid passageway 238. For example, the load-bearing cover 244 may be useful to allow people, vehicles (not shown) or other equipment or structures to move across the load-supporting surface 16 or be placed atop the drain channel 228. For another example, the cover 244 may be included to isolate or protect the fluid passageway 238.

When included, the cover 244 may have any suitable form, configuration and operation. For example, the cover 244 may be constructed at least partially of metal or fiberglass. In this example, the cover 244 is a metallic grate 248 having openings through which liquid may flow into the fluid passageway(s) 238 from above. For another example, the cover 244 may instead be a solid panel (not shown) that partially or completely covers the fluid passageway 238, allowing liquid flow into the fluid passageway(s) 238 via the feed paths 240.

Now referring back to FIG. 11, the exemplary third and fourth linear berm members 224, 226 are positionable on the perimeter 40 of the load-supporting surface 16 at the terminal ends 230, 232 of the drain channel(s) 228. Thus, the illustrated berm members 224, 226 are placed in the position normally occupied by first linear berm members 108 (FIG. 1), and are each longer than the first linear berm member 108. In this embodiment, the berm members 224, 226 are engageable with adjacent berm members 80 disposed on the perimeter 40 similarly as described above.

When the terminal ends 230, 232 of the drain channel(s) 228 are offset relative to the perimeter 40, at least one among the third and fourth linear berm members 224, 226 may include an outwardly projecting protrusion 258 engageable with the first terminal end 230, and the other linear berm member 224, 226 may include an inwardly projecting protrusion 256 engageable with the second terminal end 232. In this example, the third linear berm member 224 has the outwardly projecting protrusion 258 and the fourth linear berm member 226 has the inwardly projecting protrusion 256. The terminal end 230 of the illustrated drain channel(s) 228 extends partially beneath and rearwardly beyond the third linear berm member 224 and is covered by the outwardly projecting protrusion 258.

Now referring to FIG. 14, the liquid drain assembly 220 may include one or more drain outlet members 250 disposed at either or both ends 230, 232 of the drain channel(s) 228 and in fluid communication with the fluid passageway(s) 238 thereof to allow the drainage of fluid therefrom. The drain outlet member 250 may have any suitable form, configuration and operation. In this example, the drain outlet member 250 is disposed at the first terminal end 230 of the drain channels 228 and includes a spout 252 in fluid communication with the fluid passageway(s) 238 thereof. The exemplary spout 252 can be used to direct the existing liquid to any desired destination. For example, the spout 252 may pour the liquid directly into a sump or container, be engaged with a pipe (not shown) or other component for routing the fluid to another location, such as a processing plant.

The exemplary drain outlet member 250 releasably engages the terminal end 230 of the drain channel(s) 228 underneath the protrusion 258 of the third linear berm member 224. Specifically, the outlet member 250 has a base 251 that rests on the ground 20 below the upper and lower portions 234, 237 of the drain channel 228 at the terminal end 230. The drain outlet member 250 includes at least one locking pin hole (not shown) alignable with at least one locking pin hole 236 of the adjacent drain channel 228 and/or a locking pin hole 254 of the outwardly extending protrusion 258 of the berm member 224 to accept a locking pin 34 therethrough for releasably securing them together.

In many embodiments, all of the above components of the system 10 are durable, modular, weather-resistant and reusable. If desired, the liquid containment system 10 may be part of a spill management system to prevent liquid leakage from one or more permanent, semi-permanent or temporary load-supporting surface 16 and allow the clean-up or disposal of such liquid.

In another independent aspect of the present disclosure, the various components of the liquid containment system 10 may be sealingly engaged with adjacent components. For example, the system 10 may be used to provide a self-contained perimeter fluid barrier around the load-supporting surface 16 without the need for any liners below or adjacent to the load-supporting surface 16. For another example, some embodiments of the system 10 may be able to sealingly contain fluid that fills the area over the load-supporting surface 16 to the full vertical extent of the walls 100.

The liquid containment system 10 may be sealed in any suitable manner. Referring back to FIG. 2, in this embodiment, gaskets, or seals, 270 are sandwiched between adjacent components of the system 10 and/or the load-supporting surface 16. The gaskets 270 may have any suitable form, configuration and operation. For example, the gaskets 270 may be constructed of closed-cell neoprene foam. In this embodiment, a linear gasket 272 is placed between the horizontal base 90 of each berm member 80 and the adjacent edge 39 of the perimeter 40 of the load-supporting surface 16. For example, the linear gaskets 272 may be 2" wide, 4" tall and formed in a long strip. Likewise, as shown in FIG. 9, linear gaskets 272 may also be used between the exemplary drive over barrier 140 and the edge 39.

Referring to FIG. 6A, gaskets 270 may also be placed between the outer faces 164 of engaged end supports 160 of adjacent berm members 80. In FIGS. 6A and 16, the illustrated gaskets 270 are duck-bill shaped gaskets 280 placed between the adjacent outer faces 164 inward of the mating protrusion 166 and recess 172 (FIGS. 5A-B). For another example, in FIG. 6B, the gaskets 270 between adjacent end supports 160 are arc-shaped gaskets 282 formed in the shape of the end support 160, have connecting holes 284 therein and are placed between the adjacent mating protrusion 166 and recess 172.

FIG. 15 illustrates an exemplary gasket 270 that may be sandwiched between axially aligned drain channels 228 (FIG. 11). This exemplary gasket 270 is a dual-level linear gasket 278 formed in the cross-sectional shape of the drain channel 228. FIG. 17 illustrates an embodiment of a gasket 270 placed between the drain channel 228 (FIG. 14) and the drain outlet member 250. The illustrated gasket 270 is a key-shaped gasket 288 formed in the cross-sectional shape of the drain outlet member 250.

Preferred embodiments of the present disclosure thus offer advantages over the prior art and are well adapted to carry out one or more of the objects of this disclosure. However, the present invention does not require each of the components and acts described above and is in no way limited to the above-described embodiments or methods of operation. Any one or more of the above components, features and processes may be employed in any suitable configuration without inclusion of other such components, features and processes. Moreover, the present invention includes additional features, capabilities, functions, methods, uses and applications that have not been specifically addressed herein but are, or will become, apparent from the description herein, the appended drawings and claims.

The methods that may be described above or claimed herein and any other methods which may fall within the scope of the appended claims can be performed in any desired suitable order and are not necessarily limited to any sequence described herein or as may be listed in the appended claims. Further, the methods of the present invention do not necessarily require use of the particular embodiments shown and described herein, but are equally applicable with any other suitable structure, form and configuration of components.

While exemplary embodiments of the invention have been shown and described, many variations, modifications and/or changes of the system, apparatus and methods of the present invention, such as in the components, details of construction and operation, arrangement of parts and/or methods of use, are possible, contemplated by the patent applicant(s), within the scope of the appended claims, and may be made and used by one of ordinary skill in the art without departing from the spirit or teachings of the invention and scope of appended claims. Thus, all matter herein set forth or shown in the accompanying drawings should be interpreted as illustrative, and the scope of the disclosure and the appended claims should not be limited to the embodiments described and shown herein.

The invention claimed is:

1. A system for assisting in preventing the leakage of liquid from an outdoor work-site and allowing vehicle ingress onto and egress off of the work-site, the system comprising:

a load-supporting surface having an upper surface and including at least two adjacent mats forming a perimeter thereof, said load-supporting surface being configured to support the weight of people, vehicles and equipment thereupon, wherein said load-supporting surface is configured to be placed upon the ground, further wherein said perimeter of said load-supporting surface includes at least first and second said perimeter sides each having an upper lip extending horizontally outwardly therefrom and configured to be spaced above the ground, and at least third and fourth said perimeter sides each having a lower lip extending horizontally outwardly therefrom and configured to rest on the ground;

a plurality of berm members configured to be positioned at least partially around said perimeter of said load-supporting surface and extend upwardly relative to said mats, said berm members being configured to prevent liquid disposed upon said upper surface of said load-supporting surface from leaking off of said load-supporting surface around said perimeter of said load-supporting surface, at least one of said plurality of berm members comprising a drive-over barrier that sealingly engages said load-supporting surface; and a plurality of spacers separate and distinct from said mats, each said spacer having a first section configured to be positioned below said upper lip of at least one among said first and second perimeter sides of said load-supporting surface and a second section extending horizontally outwardly from said first section and configured to extend beyond said corresponding upper lip.

2. The system of claim 1 wherein at least two of said berm members are configured to rest at least partially atop said respective second sections of at least two of said spacers, respectively.

3. The system of claim 2 wherein each among said plurality of berm members includes front and rear portions, each said front and rear portion having a respective bottom surface, wherein said bottom surface of said front portion is higher relative to said bottom surface of said rear portion, said rear portion of each among said plurality of berm members being configured to be positioned at least partially atop at least one among the group consisting of said second section of at least one of said plurality of spacers and at least one lower lip of said third or fourth perimeter sides of said load-supporting surface.

4. A system for assisting in preventing the leakage of liquid from an outdoor work-site and allowing vehicle ingress onto and egress off of the work-site, the system comprising:

a load-supporting surface having an upper surface and including at least two adjacent, reusable mats forming a perimeter thereof, said load-supporting surface being configured to support the weight of people, vehicles and equipment thereupon, said perimeter of said load-supporting surface having at least first and second adjacent sides and at least a first corner formed by the intersection of said first and second adjacent sides;

a plurality of berm members configured to be positioned at least partially around said perimeter of said load-supporting surface and extend upwardly relative to said mats, said berm members being configured to prevent liquid disposed upon said upper surface of said load-supporting surface from leaking off of said load-supporting surface, at least one of said plurality of berm members being formed in an angular shape and configured to be positioned along said first corner of said perimeter, and at least one of said plurality of berm members comprising a drive-over bather that sealingly engages said load-supporting surface; and a plurality of spacers separate and distinct from said mats, each said spacer having a first section configured to be positioned below at least part of at least one said mat and a second section extending horizontally outwardly from said first section and configured to extend beyond said corresponding at least one mat, wherein at least two of said berm members are configured to rest at least partially atop said respective second sections of at least two of said spacers, respectively.

5. The system of claim 4 wherein each said berm member includes front and rear portions, each said front and rear portion having a respective bottom surface, wherein said bottom surface of said front portion is higher relative to said bottom surface of said rear portion, said rear portion of each said berm member being configured to be positioned at least partially atop at least one among the group consisting of said second section of at least one of said plurality of spacers and at least part of at least one said mat.

6. The system of claim 4 wherein each said mat includes a plurality of locking pin holes extending therethrough, each said berm member includes at least one locking pin hole extending therethrough and each said spacer includes at least one locking pin hole extending therethrough, further including a plurality of releasable locking pins, each said locking pin being configured to extend through and releasably couple together an adjacent pair of said locking pin holes in any among an adjacent pair of said mats, one of said mats and either an adjacent said berm member or an adjacent said spacer, and one of said berm members and an adjacent said spacer.

7. A system for assisting in preventing the leakage of liquid from an outdoor work-site and allowing vehicle ingress onto and egress off of the work-site, the system comprising:

a load-supporting surface having an upper surface and including at least two adjacent, reusable mats forming a perimeter thereof, said load-supporting surface being configured to support the weight of people, vehicles and equipment thereupon, said perimeter of said load-supporting surface having at least first and second adjacent sides and at least a first corner formed by the intersection of said first and second adjacent sides;

a plurality of berm members configured to be positioned at least partially around said perimeter of said load-supporting surface and extend upwardly relative to said mats, said berm members being configured to prevent liquid disposed upon said upper surface of said load-supporting surface from leaking off of said load-supporting surface, at least one of said plurality of berm members being formed in an angular shape and configured to be positioned along said first corner of said perimeter, and at least one of said plurality of berm members comprising a drive-over bather that sealingly engages said load-supporting surface; and at least one liquid drain assembly releasably engaged with said load-supporting surface and configured to collect liquid disposed upon and provide controlled drainage of liquid off of said load-supporting surface.

8. A system for assisting in preventing the leakage of liquid from a support surface that includes a plurality of mats, each mat having an upper surface and being configured to support the weight of people, vehicles and equipment thereupon, the support surface having a perimeter extending therearound, the system comprising:

a plurality of berm members configured to be positioned at least partially around the perimeter of the support surface and extend upwardly relative thereto, said berm members being configured to prevent liquid disposed upon the upper surface of the mats from leaking off of the mats around the perimeter of the support surface, each said berm member having front and rear edges, at least part of said front edge of each said berm member being positionable atop at least part of at least one of the mats during use of the system, at least one of said plurality of berm members comprising a drive-over barrier that sealingly engages the support surface; and a plurality of spacers separate and distinct from the mats, each said spacer having a first section configured to be positioned below at least part of at least one of the mats and a second section extending horizontally outwardly from said first section and configured to extend beyond the corresponding at least one mat, wherein at least two of said berm members are configured to rest at least partially atop said respective second sections of at least two of said spacers, respectively.

9. The system of claim 8 wherein each said berm member includes front and rear portions, each said front and rear portion having a respective bottom surface, wherein said bottom surface of said front portion is higher relative to said bottom surface of said rear portion, said rear portion of each said berm member being configured to be positioned at least partially atop at least one among the group consisting of said second section of at least one of said plurality of spacers and at least part of at least one mat.

10. The system of claim 9 wherein each mat includes a plurality of locking pin holes extending therethrough, each said berm member includes at least one locking pin hole extending therethrough and each said spacer includes at least one locking pin hole extending therethrough, further including a plurality of releasable locking pins, each said locking pin being configured to extend through and releasably couple together an adjacent pair of said locking pin holes in any among an adjacent pair of mats, one of the mats and either an adjacent said berm member or an adjacent said spacer, and one of said berm members and an adjacent said spacer.

11. A system for assisting in preventing the leakage of liquid from a support surface that includes a plurality of mats, each mat having an upper surface and being configured to support the weight of people, vehicles and equipment thereupon, the support surface having a perimeter extending therearound, the system comprising:

a plurality of berm members configured to be positioned at least partially around the perimeter of the support surface and extend upwardly relative thereto, said berm members being configured to prevent liquid disposed upon the upper surface of the mats from leaking off of the mats around the perimeter of the support surface, each said berm member having front and rear edges, at least part of said front edge of each said berm member being positionable atop at least part of at least one of the mats during use of the system, at least one of said plurality of berm members comprising a drive-over barrier that sealingly engages the support surface; and at least one liquid drain assembly releasably engaged with the support surface and configured to collect liquid disposed upon and provide controlled drainage of liquid off of the support surface.

12. A system for assisting in preventing the leakage of liquid from an outdoor work-site and allowing vehicle ingress onto and egress off of the work-site, the system comprising:

a load-supporting surface having an upper surface and including at least two adjacent mats forming a perimeter thereof, said load-supporting surface being configured to support the weight of people, vehicles and equipment thereupon; and a plurality of berm members configured to be positioned at least partially around said perimeter of said load-supporting surface and extend upwardly relative to said mats, said berm members being configured to prevent liquid disposed upon said upper surface of said load-supporting surface from leaking off of said load-supporting surface around said perimeter of said load-supporting surface, at least one of said plurality of berm members comprising a drive-over barrier that sealingly engages said load-supporting surface, wherein each said drive-over barrier includes front and rear edges and a ramp portion extending between said front and rear edges, said ramp portion having upwardly angled faces disposed at least partially along said front and rear edges of said drive-over barrier to allow vehicles to move up, over and down said ramp portion when entering and leaving said load-supporting surface.

13. The system of claim 12 wherein said load-supporting surface is configured to be placed upon the ground, further wherein each said mat is sealingly engaged with each respective adjacent said mat to form a liquid-tight seal therebetween and each said berm member is sealing engaged with each respective adjacent said mat and each respective adjacent said berm member to form a respective liquid-tight seal therebetween, wherein said load-supporting surface and said berm members are configured to prevent the leakage of liquid from the outdoor work-site onto the ground without the need for any liners disposed beneath or adjacent to said load-supporting surface.

14. The system of claim 12 wherein said load-supporting surface includes at least one outer edge extending therearound and each said berm member is configured to sealing engage a portion of said at least one outer edge.

15. The system of claim 12 further including a plurality of releasable locking pins, each said locking pin being configured to extend through and releasably couple together an adjacent pair of said locking pin holes in an adjacent pair of said mats or one of said mats and an adjacent said berm member.

16. A system for assisting in preventing the leakage of liquid from an outdoor work-site and allowing vehicle ingress onto and egress off of the work-site, the system comprising:

a load-supporting surface having an upper surface and including at least two adjacent, reusable mats forming a perimeter thereof, said load-supporting surface being configured to support the weight of people, vehicles and equipment thereupon, said perimeter of said load-supporting surface having at least first and second adjacent sides and at least a first corner formed by the intersection of said first and second adjacent sides; and a plurality of berm members configured to be positioned at least partially around said perimeter of said load-supporting surface and extend upwardly relative to said mats, said berm members being configured to prevent liquid disposed upon said upper surface of said load-supporting surface from leaking off of said load-supporting surface, at least one of said plurality of berm members being formed in an angular shape and configured to be positioned along said first corner of said perimeter, and at least one of said plurality of berm members comprising a drive-over bather that sealingly engages said load-supporting surface, wherein each said drive-over bather includes front and rear edges and a ramp portion extending between said front and rear edges, said ramp portion having upwardly angled faces disposed at least partially along said front and rear edges of said drive-over barrier to allow vehicles to move up, over and down said ramp portion when entering and leaving said load-supporting surface.

17. The system of claim 16 wherein said load-supporting surface is configured to be placed upon the ground, further wherein each said mat is sealingly engaged with each respective adjacent said mat to form a liquid-tight seal therebetween and each said berm member is sealing engaged with each respective adjacent said mat and each respective adjacent said berm member to form a respective liquid-tight seal therebetween, wherein said load-supporting surface and said berm members are configured to prevent the leakage of liquid from the outdoor work-site onto the ground without the need for any liners disposed beneath or adjacent to said load-supporting surface.

18. The system of claim 17 wherein said load-supporting surface includes at least one outer edge extending therearound and each said berm member is configured to sealing engage a portion of said at least one outer edge.

19. The system of claim 17 further including a plurality of releasable locking pins, each said locking pin being configured to extend through and releasably couple together an adjacent pair of said mats or one of said mats and an adjacent said berm member.

20. A system for assisting in preventing the leakage of liquid from a support surface that includes a plurality of mats, each mat having an upper surface and being configured to support the weight of people, vehicles and equipment thereupon, the support surface having a perimeter extending therearound, the system comprising:

a plurality of berm members configured to be positioned at least partially around the perimeter of the support surface and extend upwardly relative thereto, said berm members being configured to prevent liquid disposed upon the upper surface of the mats from leaking off of the mats around the perimeter of the support surface, each said berm member having front and rear edges, at least part of said front edge of each said berm member being positionable atop at least part of at least one of the mats during use of the system, at least one of said plurality of berm members comprising a drive-over barrier that sealingly engages the support surface, wherein each said drive-over barrier includes front and rear edges and a ramp portion extending between said front and rear edges, said ramp portion having upwardly angled faces disposed at least partially along said front and rear edges of said drive-over barrier to allow vehicles to move up, over and down said ramp portion when entering and leaving the support surface.

* * * * *